US006494175B2

(12) United States Patent
Gracyalny

(10) Patent No.: US 6,494,175 B2
(45) Date of Patent: Dec. 17, 2002

(54) MECHANICAL COMPRESSION RELEASE

(75) Inventor: Gary J. Gracyalny, Milwaukee, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 09/782,468

(22) Filed: Feb. 9, 2001

(65) Prior Publication Data

US 2002/0108595 A1 Aug. 15, 2002

Related U.S. Application Data

(63) Continuation-in-part of application No. 09/507,070, filed on Feb. 18, 2000, now Pat. No. 6,349,688.

(51) Int. Cl.[7] ..... F01G 13/08
(52) U.S. Cl. ..... 123/182.1
(58) Field of Search ..... 123/182.1

(56) References Cited

U.S. PATENT DOCUMENTS

| | | | | |
|---|---|---|---|---|
| 3,314,408 A | * | 4/1967 | Fenton | 123/182.1 |
| 3,362,390 A | | 1/1968 | Esty | |
| 3,395,689 A | | 8/1968 | Kruse | |
| 3,897,768 A | | 8/1975 | Thiel | |
| 4,453,507 A | | 6/1984 | Braun et al. | |
| 4,977,868 A | | 12/1990 | Holschuh | |
| 4,991,551 A | | 2/1991 | Terai et al. | |
| 5,085,184 A | | 2/1992 | Yamada et al. | |
| 5,150,674 A | | 9/1992 | Gracyalny | |
| 5,301,643 A | | 4/1994 | Garcyalny | |
| 5,687,683 A | | 11/1997 | Knoblauch | |
| 5,809,958 A | | 9/1998 | Gracyalny | |
| 5,943,992 A | | 8/1999 | Kojima et al. | |

FOREIGN PATENT DOCUMENTS

EP 0515 183 A1 5/1992

* cited by examiner

*Primary Examiner*—Gene Mancene
*Assistant Examiner*—Arnold Castro
(74) *Attorney, Agent, or Firm*—Michael Best & Friedrich LLP

(57) ABSTRACT

An internal combustion engine has a mechanical compression release including a cam, a cam follower, and a compression release member. The cam having a cam lobe and a base radius with a slot, and a compression release member disposed within the slot. The compression release member is substantially V-shaped and is comprised of a first portion, a second portion, and a bridging portion. The first portion has an auxiliary cam surface that extends slightly beyond the base radius and the second portion has sufficient mass to function as a flyweight. The bridging portion is substantially U-shaped and connects the first and second portions. The compression release member pivots about a pivot pin, that is disposed within the curved portion of the bridging portion. As the cam rotates, centrifugal forces cause the compression release member to pivot and to disengage from the cam follower.

28 Claims, 6 Drawing Sheets

MECHANICAL COMPRESSION RELEASE

This patent application is a continuation-in-part of an claims priority from the earlier U.S. patent application Ser. No. 09/507,070 filed Feb. 18, 2000, now U.S. Pat. No. 6,349,688 which is incorporated herein by reference.

FIELD OF THE INVENTION

This invention relates to internal combustion engines, and more particularly to a centrifugally responsive mechanical compression release.

BACKGROUND OF THE INVENTION

Compression release mechanisms are common in pull-start engines to make the engines easier to start. In a normal pull-start engine, the operator pulls a rope which moves the engine through one or more cycles. During the compression stroke of the engine cycle, the operator must exert enough force to compress the air in the combustion chamber, and the additional force from compressing the air makes it more difficult to start the engine. In a pull-start engine with a compression release mechanism, pressure in the combustion chamber is slightly released during the compression stroke to reduce the resistive force on the rope. This makes the engine easier to start because the operator does not have to pull the rope as hard. Typically, a compression release mechanism slightly unseats the exhaust valve to vent the combustion chamber during starting while the engine is revolving at cranking speeds. The mechanism then typically disengages when the engine reaches normal operating speeds.

Some compression release mechanisms use centrifugal forces to disengage themselves from the cam follower. These designs generally have a cam member and a flyweight. When the cam shaft rotation speed reaches a certain point, the flyweight moves away from the cam shaft, which positions the cam member out of contact with the cam follower. Some previous saddle-type compression release designs had pivot points on the cam shaft that required machining or drilling of the cam shaft. Modifying and machining a cam shaft is difficult because of its hardness and curved surface. The flyweights of some saddle-type designs also required apertures in the cam gear for clearance.

Other compression release mechanisms involve complex shapes that are difficult to manufacture and assemble. Complex designs usually require additional manufacturing steps which increase the cost of the part. Also, a complex part usually takes longer to assemble and is more likely to be assembled improperly.

SUMMARY OF THE INVENTION

The present invention includes a cam with a cam lobe and base radius. The cam is preferably slip fit over a cam shaft. A compression release member is preferably located adjacent the base radius and retained by a retainer, although the compression release member could be placed in other locations. In one embodiment, the compression release member is disposed in a slot on the base radius. The compression release member preferably comprises a first portion, a second portion, and a bridging portion that interconnects the first and second portions. Preferably, the first portion has an arc-shaped auxiliary cam surface that engages a cam follower, and the second portion functions as a flyweight. The pivot pin is preferably disposed within the curvature of the bridging portion and retains the compression release member in the slot. The bridging portion contacts the back surface of the slot, which absorbs the forces the cam follower applies on the compression release member. In the preferred embodiment, the compression release member may be symmetrical about a line through the bridging portion, but by no means is the invention limited to this embodiment. A symmetrical design provides additional benefits, but is not necessary to practice this invention.

In operation, the cam follower contacts the cam lobe as the cam shaft rotates. The compression release member is located in a slot along the base radius. At low speeds, the auxiliary cam surface engages the cam follower and slightly lifts the cam follower from the cam. Once the engine reaches higher running speeds, centrifugal forces pivot the compression release member out of contact with the cam follower.

The present invention achieves many advantages over previous compression release mechanisms. Biasing springs are not needed when the invention is incorporated into vertical shaft engines. The costly process of machining the cam shaft is no longer necessary because the compression release member is preferably integrated into the cam, which can be slip fit over the cam shaft. This arrangement can be readily integrated into an engine utilizing a cam lever and direct lever overhead valve system.

The back surface of the slot bears the forces the cam follower applies upon the compression release member. This substantially flat back surface is capable of supporting a relatively large amount of force and minimizes the forces applied on the pivot pin. The auxiliary cam surface is curved so there are no corners to cut into the cam follower. The cam follower is also preferably curved, and this smooth transition of the cam follower from the base radius to the compression release member extends the life of the parts.

In the preferred embodiment applied to a 5 hp engine, the compression release member is approximately 0.375 inches wide. This width dimension is wider than most previous compression release mechanisms and allows the forces transferred to the back surface to be distributed along a larger surface area. One skilled in the art will realize the invention does not require this large of a width dimension, and the size of the compression release member ultimately depends on the size of the cam lobe and the engine. The invention is by no means limited to this dimension, which merely provides an additional benefit of the preferred embodiment.

Additional advantages of this invention are derived from its efficient design. The compression release member may be easily stamped, or cut from a metal coil and bent into the proper shape. As previously mentioned, the compression release member may be symmetrical about a line through the bridging portion. While not necessary, the symmetrical design provides benefits during assembly of the invention. Since both the first and second portions are the substantially the same in this embodiment, either arced surface may be the auxiliary cam surface; the compression release member cannot be placed in the slot upside-down. This feature saves time during the assembly process, eliminates many misassembled parts, and reduces costs.

Figure 1:
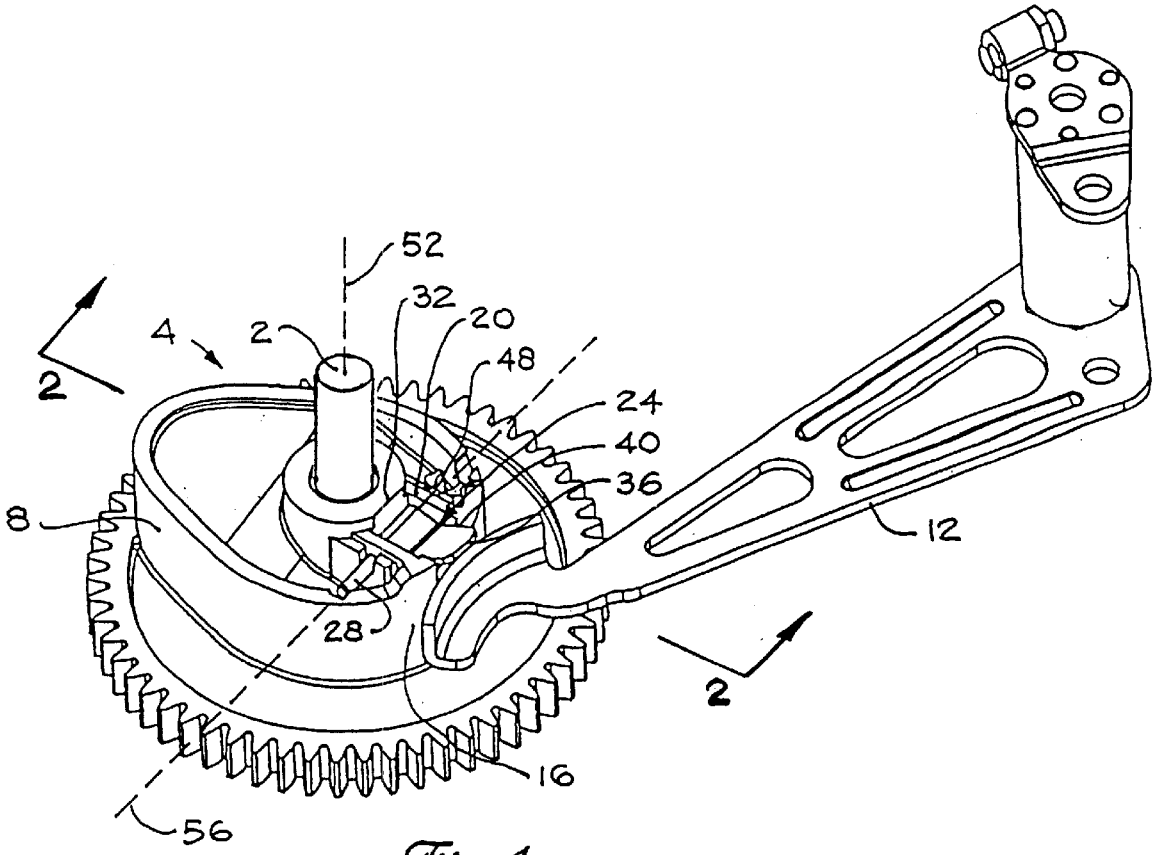
FIG. 1 is a perspective view of the cam follower and cam gear with the compression release member in the disengaged position.

Before the embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 3:
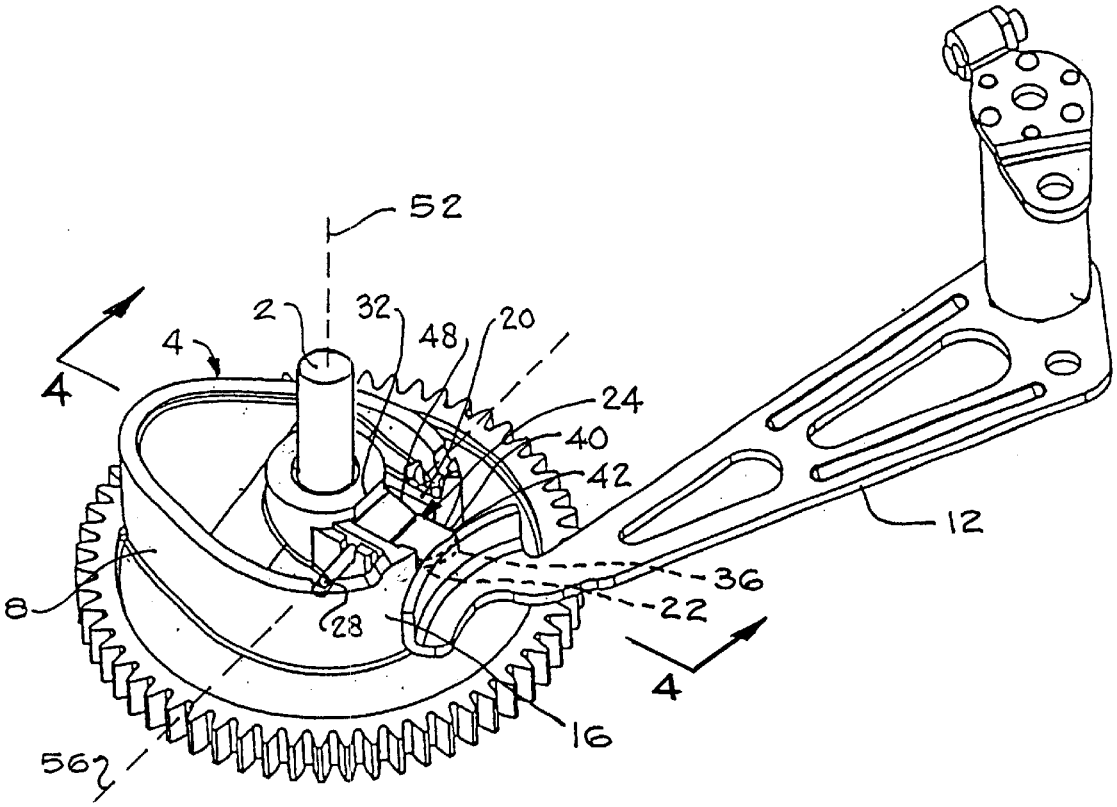
FIG. 3 is a perspective view of the cam gear with the compression release member in the engaged position.
Figure 4:
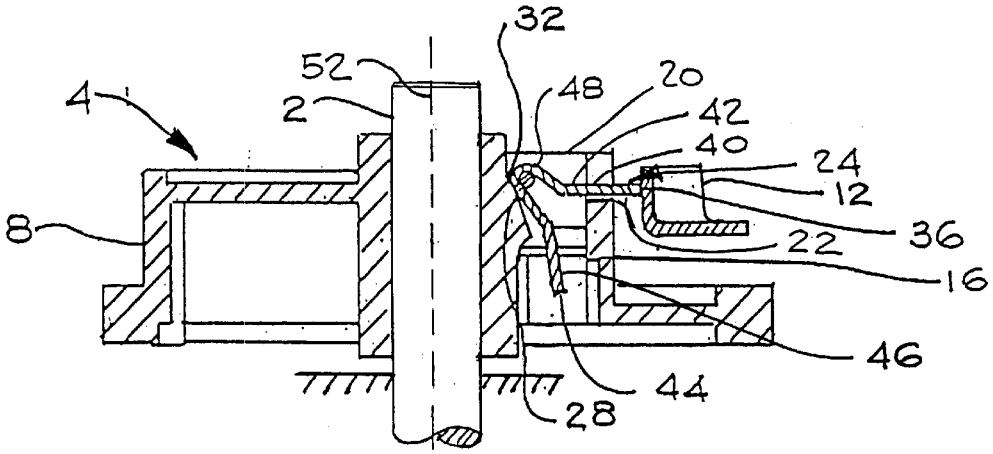
FIG. 4 is a cross-sectional view, taken along line 4—4 of FIG. 3 with the cam follower in contact with the compression release member.

FIGS. 3 and 4 illustrate the cam 4 with the compression release member 24 in the engaged position while the engine is rotating at starting speeds. The cam 4 includes a cam lobe 8, a base radius 16, and a slot 20 that extends into, and is formed in the base radius 16. The compression release member 24 is pivotably retained in the slot 20 between the base radius 16 and the cam shaft 2.

In FIG. 4, the compression release member 24 is substantially V-shaped and consists of a first portion 40, a second portion 44 and a bridging portion 48. The first portion 40 and second portion 44 are preferably substantially flat surfaces. An arc-shaped auxiliary cam surface 36 at the end of the first portion 40 extends slightly beyond the base radius 16 to contact the cam follower 12. The second portion 44 preferably has sufficient mass to function as a flyweight. Preferably, the bridging portion 48 is substantially U-shaped and interconnects the first portion 40 and second portion 44. The pivot pin 28 is disposed within the curved segment of the bridging portion 48.

In the preferred embodiment, the first portion 40 and second portion 44 may be substantially identical and the compression release member may be symmetrical about a line through the bridging portion 48 that is substantially parallel to the pivot axis 56 (FIG. 3). This configuration is not necessary for the invention to function, but a symmetrical design offers advantages during the device's assembly. If the first portion 40 and second portion 44 are interchangeable, the compression release member 24 can be installed with the first and second portions 40, 44 reversed. This eliminates confusion, saves time, and reduces costs during assembly.

The overall design of the compression release member 24 provides for cost effective manufacturing methods. Preferably, the compression release member 24 is cut from a strip of coiled metal and bent into the desired shape. The compression release member 24 could also be stamped from a metal strip or sheet. Relatively little waste material is generated from these processes due to the part's efficient design. The inexpensive material along with the uncomplicated manufacturing process leads to the reduced cost of the compression release member 24.

The compression release member 24 is preferably retained in the slot 20 by a pivot pin 28. In the preferred embodiment, planes containing the substantially flat surfaces 42, 46 respectively of the first portion 40 and the second portion 44 are substantially parallel to the pivot axis 56. The compression release member 24 is free to pivot about the pivot pin 28, and the pivot axis 56 of the compression release member 24 substantially passes through the pivot pin 28. The compression release member 24 is positioned such that the cam shaft 2 and the pivot axis 56 do not intersect. Costly machining of the cam shaft 2 is no longer needed because the pivot axis 56 is offset from the cam shaft 2.

The pivot pin 28 preferably does not support the force exerted on the compression release member 24 by the cam follower 12. The bridging portion 48 contacts the back surface 32 which buttresses the compression release member 24. Most of the force the cam follower 12 applies on the compression release member 24 is absorbed by the back surface 32. Because of this arrangement, the pivot pin 28 will not suffer from large shear stresses and may last longer.

While in the engaged position, the first portion 40 contacts the shoulder 22, which provides vertical support for the compression release member 24. In the preferred embodiment, the first portion 40 is positioned vertically below the pivot pin 28 when installed on a vertical shaft engine. When the auxiliary cam surface 36 is below the pivot pin 28, gravity returns the compression release member 24 to the engaged position, so a biasing spring is not needed in vertical shaft applications. A return spring may be needed in a horizontal shaft application. This arrangement also allows the cam follower 12 to apply a downward force upon the compression release member 24 and prevent the compression release member 24 from moving out of the engaged position prematurely. Another feature is that once the speed increases enough to move the auxiliary cam surface 36 above the pivot pin 28, the cam follower 12 will help push the compression release member 24 to the disengaged position.

Figure 2:
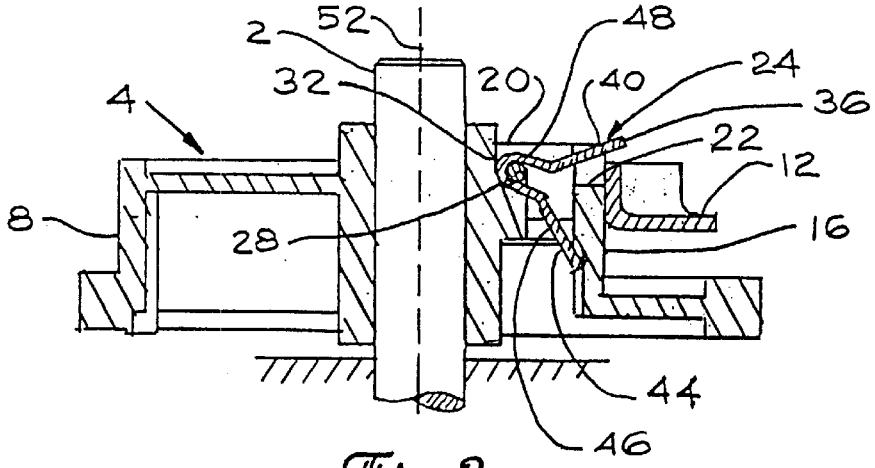
FIG. 2 is a cross-sectional view, taken along line 2—2 of FIG. 1.

FIGS. 1 and 2 illustrate the compression release member 24 in the disengaged position. As the rotation speed of the cam 4 reaches normal running speeds, the flyweight second portion 44 is centrifugally forced away from the cam shaft 2, causing the compression release member 24 to pivot into the disengaged position. The auxiliary cam surface 36 then moves out of contact from the cam follower 12. In the preferred embodiment applied to a 5 hp engine, the kick-out speed when the compression release member moves to the disengaged position is approximately 600 RPM, but it could vary between 300 and 1200 RPM. The compression release member 24 in the preferred embodiment pivots approximately 20 degrees, but one skilled in the art will recognize that this angle depends on the length of the compression release member 24 and size of the engine. In an engine with a cam 4 having a smaller base radius 16 and shorter compression release member 24, the compression release member 24 may pivot 25 to 30 degrees before the auxiliary cam surface 36 disengages from the cam follower 12.

Figure 5:
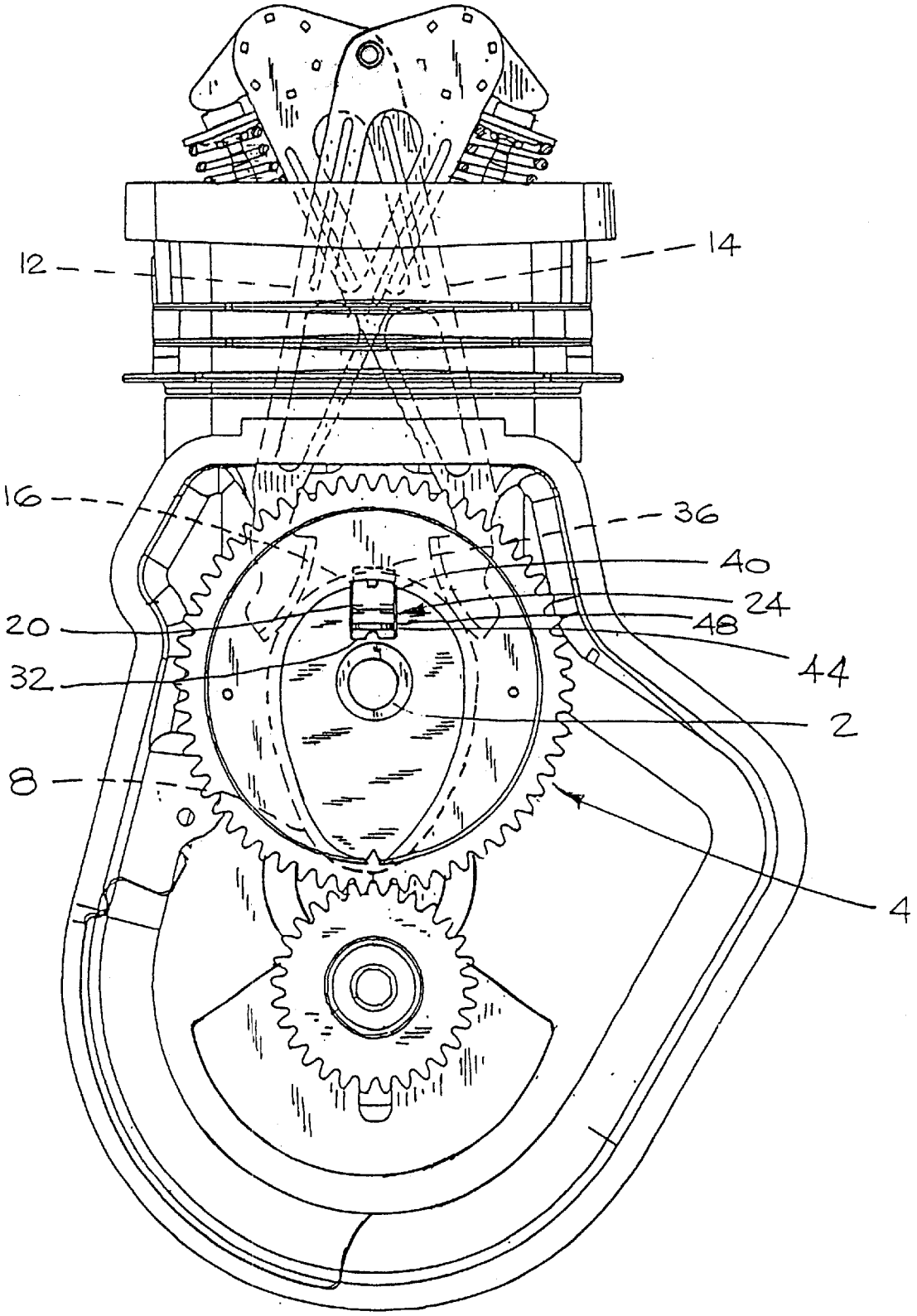
FIG. 5 is a bottom view of an overhead valve engine embodying the invention with the engine crankcase cover removed.

A preferred embodiment of the mechanical compression release 24 of the present invention is illustrated in FIG. 5 as it would appear in a vertical shaft engine with a direct lever overhead valve system. A preferred embodiment has one cam lobe 8. An alternative embodiment could have two cam lobes, one for each valve actuation. The cam 4 preferably slips over the cam shaft 2 and rotates about the cam shaft 2, which is pressed into the crankcase cover. In this embodiment, the cam shaft 2 is stationary, although the cam shaft 2 could rotate with the cam lobe 8 in other embodiments.

The cam 4 preferably consists of the base radius 16 and the cam lobe 8. The cam followers 12, 14 control the exhaust and intake valves respectively and contact the cam 4 as it rotates. A valve is closed when a cam follower 12, 14 engages the base radius 16, and opened when a cam follower 12, 14 engages the cam lobe 8. The cam followers 12, 14 respectively for the exhaust and intake valves preferably contact the cam 4 at slightly different levels. The cam 4 preferably has a slot 20 that extends into the base radius 16. A compression release member 24 is preferably disposed within this slot 20 at a level that is only capable of contacting the exhaust valve cam follower 12 as the cam 4 rotates. In the alternative, compression release member 24 could operate on the intake valve.

Figure 7:
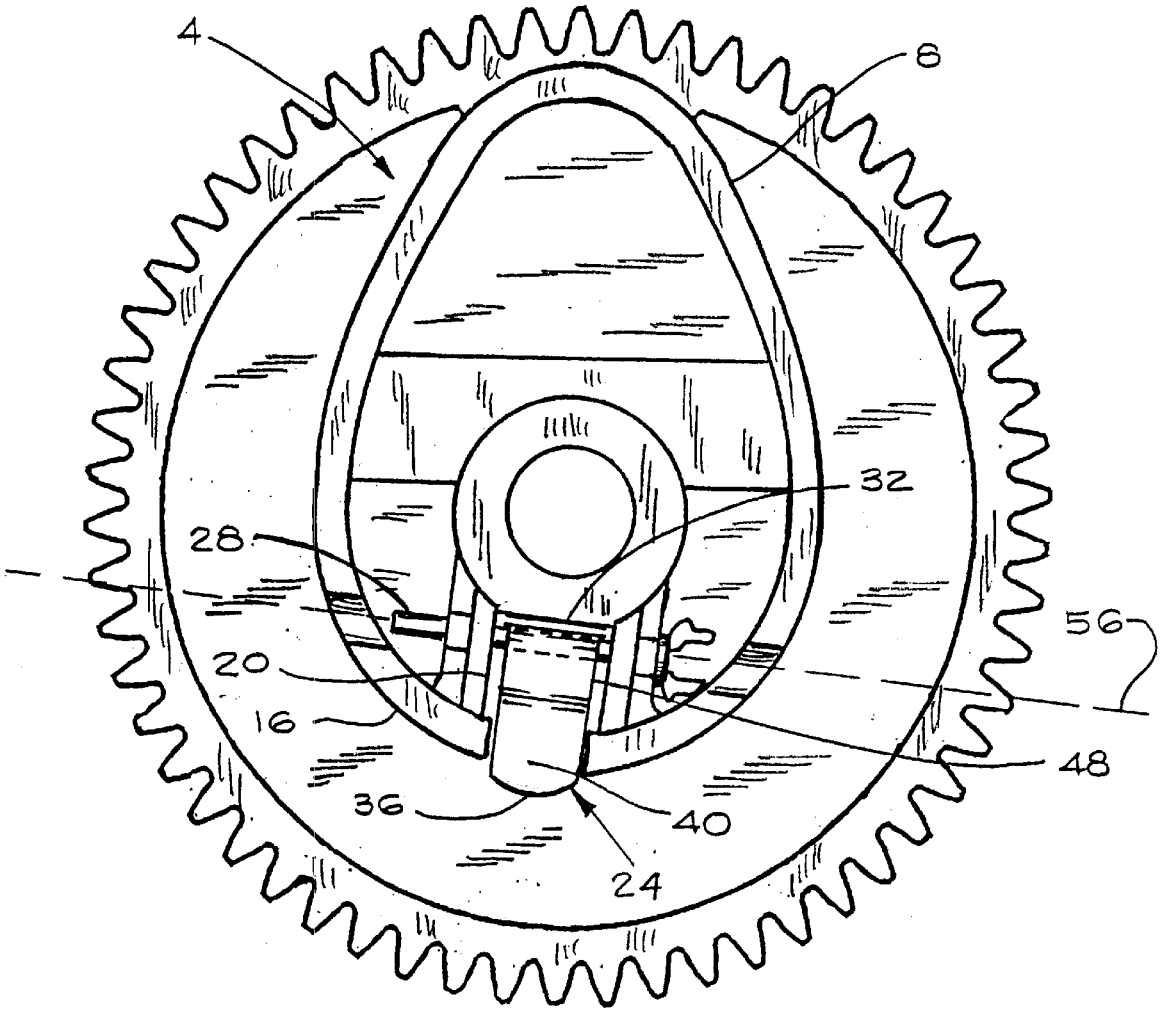
FIG. 7 is a top view of the cam gear showing a pivot pin to retain the compression release member.

FIG. 7 illustrates a view of the cam 4. The compression release member 24 of the present invention is preferably interconnected with the rotating cam 4, although the compression release member 24 could be placed in other locations. In the preferred embodiment, the compression release member 24 is disposed within the slot 20, and the auxiliary cam surface 36 extends slightly beyond the base radius 16. In the preferred embodiment, the compression release member 24 can be located between the base radius 16 and the cam shaft 2 because this engine design uses a relatively large cam 4.

The auxiliary cam surface 36 is preferably arc-shaped so there are no corners to contact the cam follower 12 (FIG. 3) and cause excessive wear. Cam follower 12 (FIG. 3) is also preferably arc-shaped to reduce wear on the parts. As the cam 4 rotates, the compression release member 24 preferably moves the cam follower 12 (FIG. 3) far enough from the base radius 16 to slightly open the exhaust valve. The shape of the auxiliary cam surface 36 is selected to obtain a specific valve opening profile. In the preferred embodiment applied to a 5 hp engine of the direct lever type, the compression release member 24 causes the exhaust valve to open approximately 0.035 inches.

Figure 6:
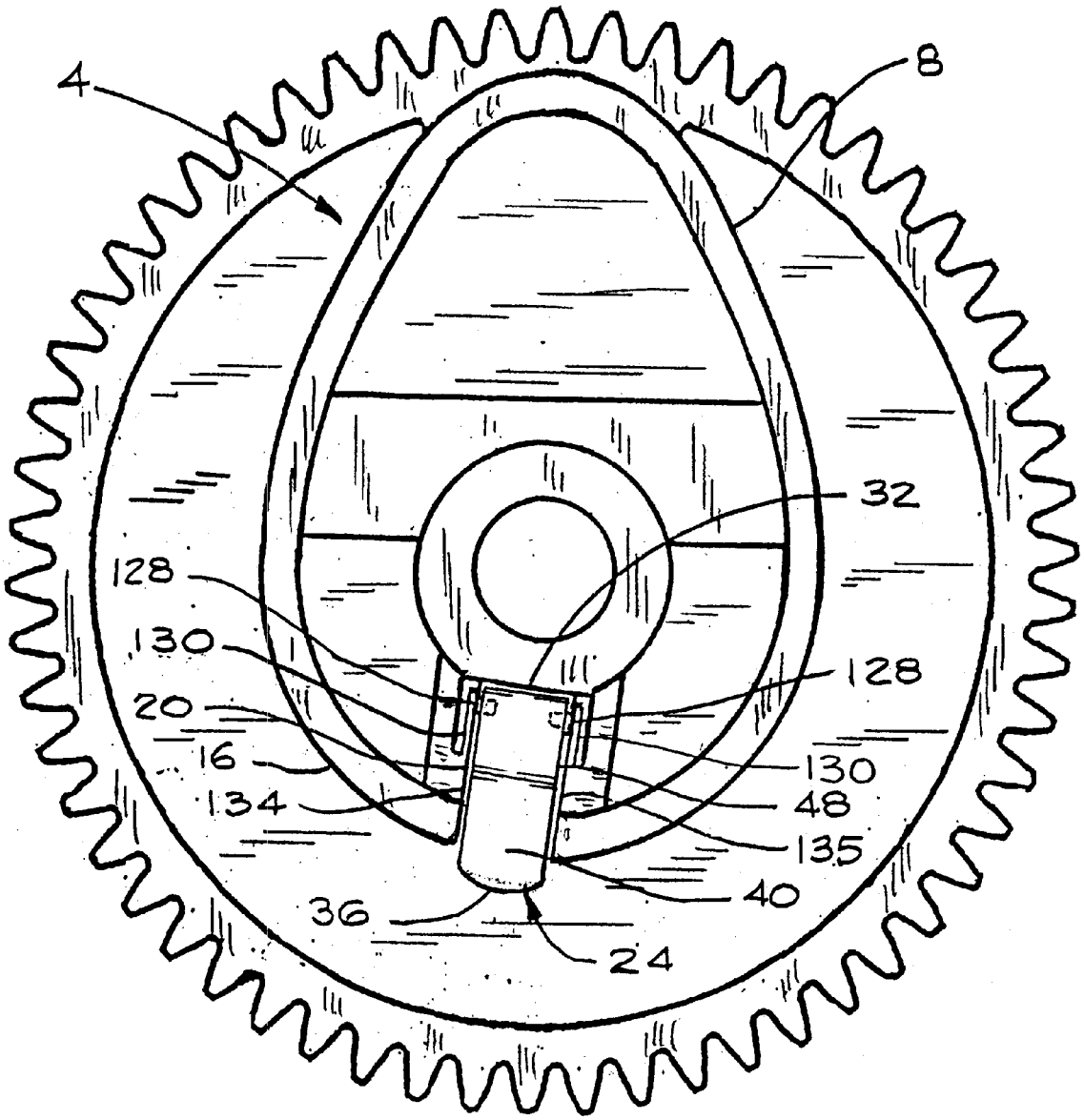
FIG. 6 is a top view of the cam gear showing nubs to retain the compression release member.

The compression release member 24 is preferably retained by a retainer. As illustrated in FIG. 7, the compression release member 24 is retained by the pivot pin 28. In an alternate embodiment illustrated in FIG. 6, nubs 128 are used to retain the compression release member 24. The cam 4 may be fabricated with the nubs 128 integrally formed on the opposing side walls 134, 135 of the slot 20. Preferably, the nubs 128 are at the end of flexible extensions 130 that interconnect them to the slot 20. With the nubs 128, the compression release member 24 can simply be pressed into place without the additional assembly step of installing the pivot pin 28 (FIG. 7). The flexible extensions 130 allow the nubs 128 to bend and provide clearance for the compression release member 24, and then return to their original positions to properly retain the compression release member 24.

The nubs 128 serve the same function as the pivot pin 28 (FIG. 7) and eliminate the need for a separate pivot pin 28 (FIG. 7). The design of the cam 4 and the compression release member 24 allows the nubs 128 to be substituted for the relatively stronger pivot pin 28 (FIG. 7). As mentioned above, the force applied on the compression release member 24 by the cam follower 12 (FIG. 3) is supported by the back surface 32. Therefore the nubs 128 preferably only retain the compression release member 24, and do not have to be of sufficient strength to support all of the forces applied on the compression release member 24.

Figure 8:
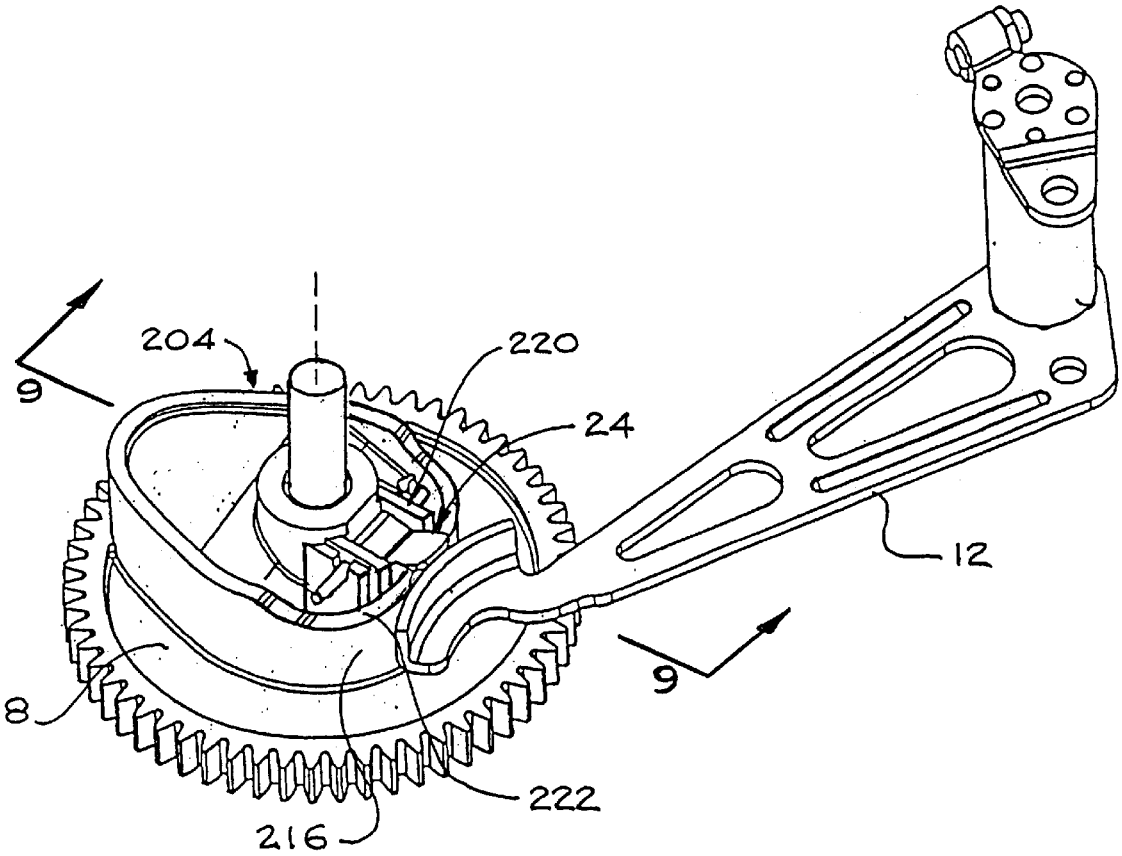
FIG. 8 is a perspective view of an alternative embodiment of the cam follower and cam gear with the compression release member in the disengaged position.
Figure 9:
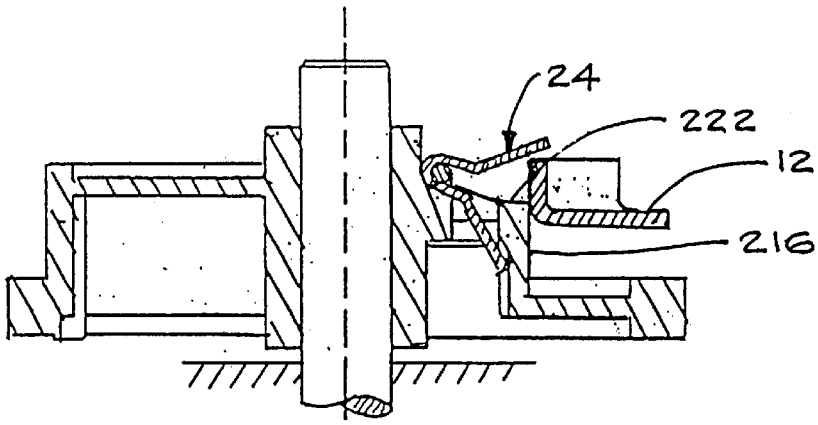
FIG. 9 is a cross-sectional view, taken along line 9—9 of FIG. 8.

Another alternate embodiment is illustrated in FIGS. 8 and 9 in which the slot 220 does not extend all the way to the base radius 216. In this embodiment, the edge of the cam 204 gradually slopes to the shoulder 222 instead of suddenly dropping off near the end of the slot 20 (FIG. 4). This embodiment shows the compression release member 24 in the disengaged position, and the cam follower 12 contacting the base radius 216. The edge of the cam 204 near the base radius 216 slopes to meet the shoulder 222, but there is still enough surface remaining on the base radius 216 to properly position the cam follower 12.

What is claimed is:

1. An internal combustion engine, comprising:

a cam shaft;

a cam having a cam lobe that engages a cam follower to lift an engine valve;

a base radius; and a compression release member, pivotably retained by a retainer adjacent said base radius, that engages said cam follower at engine starting speeds, said compression release member including a pivot axis that is substantially transverse to but does not intersect said cam shaft.

2. The engine of claim 1, wherein said retainer is at least one pivot pin that retains said compression release member.

3. The engine of claim 1, wherein said retainer includes two nubs formed integral with said cam.

4. The engine of claim 1, further comprising a slot formed in said base radius, wherein said compression release member is disposed within said slot.

5. The engine of claim 4, wherein said slot is partially defined by a back surface that bears load forces imparted on said compression release member by said cam follower.

6. The engine of claim 1, wherein said pivot axis is substantially parallel to said back surface.

7. The engine of claim 1, wherein said cam shaft extends in a vertical direction during normal engine operation, wherein said compression release member has an auxiliary cam surface that engages the cam follower, wherein said compression release member has a pivot axis, and wherein the auxiliary cam surface is disposed at a position lower than said pivot axis in the vertical direction.

8. The engine of claim 1, wherein said compression release member has an arc-shaped auxiliary cam surface that engages the cam follower.

9. The engine of claim 1, wherein said compression release member pivots about a pivot axis, and wherein said compression release member is symmetrical about said pivot axis.

10. The engine of claim 1, wherein said compression release member is substantially V-shaped.

11. The engine of claim 1, wherein said compression release member includes:

a first portion having an auxiliary cam surface that engages said cam follower;

a second portion having sufficient mass to function as a flyweight; and a bridging portion that interconnects said first and second portions.

12. The engine of claim 11, wherein said first and second portions are substantially identical.

13. The engine of claim 1, wherein the pivot axis is disposed between said base radius and said cam shaft.

14. The engine of claim 1, wherein said cam includes a back surface that bears load forces imparted on said compression release member by said cam follower, and said compression release member includes a U-shaped portion having a rounded surface that contacts said back surface while said compression release member pivots with respect to said cam.

15. The engine of claim 11, wherein said compression release member pivots about a pivot axis disposed between said first and second portions.

16. The engine of claim 15, wherein said compression release member pivots between an engaged position, in which said auxiliary cam surface engages said cam follower at engine starting speeds, and a disengaged position, in which said auxiliary cam surface does not engage said cam follower, and wherein both said first and second portions are disposed radially outwardly from said pivot axis with respect to said cam shaft when said compression release member is in the disengaged position.

17. An internal combustion engine, comprising:

a cam shaft;

a cam having a cam lobe that engages a cam follower to lift an engine valve;

a base radius; and a compression release member, pivotally retained by a retainer to pivot about a pivot axis between an engaged position, in which said compression release member engages said cam follower at engine starting speeds, and a disengaged position, in which said compression release member does not engage said cam follower, wherein said pivot axis is disposed between said base radius and said cam shaft.

18. The engine of claim 17, wherein said pivot axis is substantially transverse to but does not intersect said cam shaft.

19. The engine of claim 17, wherein said compression release member is substantially symmetrical about said pivot axis.

20. The engine of claim 17, wherein said base radius further comprises a slot in which said compression release member is at least partially disposed, and wherein said slot is partially defined by a back surface that bears load forces imparted on said compression release member by said cam follower.

21. The engine of claim 17, wherein said cam includes a back surface that bears load forces imparted on said compression release member by said cam follower, and said compression release member includes a U-shaped portion having a rounded surface that contacts said back surface while said compression release member pivots with respect to said cam.

22. The engine of claim 17, wherein said compression release member includes:

a bridging portion adjacent said pivot axis;

a first portion extending outwardly from said bridging portion and having an auxiliary cam surface; and a second portion extending outwardly from said bridging portion and having sufficient mass to function as a flyweight, wherein said bridging portion interconnects said first and second portions, and wherein both said first and second portions are disposed radially outwardly from said pivot axis with respect to said cam shaft when said compression release member is in the disengaged position.

23. The engine of claim 22, wherein said first portion and said second portion are substantially identical.

24. The engine of claim 22, wherein said compression release member is substantially V-shaped.

25. A compression release member for an internal combustion engine, comprising:

a bridging portion, wherein said compression release member is pivotally retained to pivot about a pivot axis adjacent said bridge portion;

a first portion extending outwardly from said bridging portion;

a second portion extending outwardly from said bridging portion, wherein said first portion and said second portion are substantially identical, and said compression release member is substantially symmetrical about said pivot axis; and wherein one of said first portion and said second portion engages a cam follower at engine starting speeds.

26. The member of claim 25, wherein said compression release member is substantially V-shaped.

27. The member of claim 25, wherein the other of said first portion and said second portion has sufficient mass to function as a flyweight.

28. The member of claim 25, wherein said compression release member is retained adjacent a cam and cam shaft, and said pivot axis does not intersect said cam shaft.

* * * * *